US009416552B2

(12) United States Patent
Karlsen et al.

(10) Patent No.: US 9,416,552 B2
(45) Date of Patent: Aug. 16, 2016

(54) ERECTOR SCAFFOLD DECK FALL ARREST ASSEMBLY

(75) Inventors: Stig Karlsen, Burlington, WI (US); Robert Peter Wiegers, Fox Point, WI (US); Roger S. Frank, New Berlin, WI (US); Scott D. Libert, Waukesha, WI (US); Stephen Mariscal, Racine, WI (US); Michael J. Leszczynski, Milwaukee, WI (US); Patrick Vieux, Rosiere (FR); Kamay Matharu, Ontario (CA)

(73) Assignees: Tractel Ltd, Ontario (CA); Safway Services, LLC, Waukesha, WI (US)

( * ) Notice: Subject to any disclaimer, the term of this patent is extended or adjusted under 35 U.S.C. 154(b) by 473 days.

(21) Appl. No.: 12/530,741

(22) PCT Filed: Mar. 28, 2008

(86) PCT No.: PCT/US2008/058720

§ 371 (c)(1),
(2), (4) Date: Sep. 10, 2009

(87) PCT Pub. No.: WO2008/121854

PCT Pub. Date: Oct. 9, 2008

(65) Prior Publication Data

US 2010/0089693 A1 Apr. 15, 2010

Related U.S. Application Data

(60) Provisional application No. 60/909,316, filed on Mar. 30, 2007.

(51) Int. Cl.

| | |
|---|---|
| ***A62B 35/00*** | (2006.01) |
| ***E04G 5/00*** | (2006.01) |
| ***E04G 1/15*** | (2006.01) |

(52) U.S. Cl.
CPC *E04G 5/00* (2013.01); *E04G 1/154* (2013.01); *E04G 5/001* (2013.01)

(58) Field of Classification Search
CPC ..... E04G 5/001
USPC ..... 182/119, 222, 223
See application file for complete search history.

(56) References Cited

U.S. PATENT DOCUMENTS 2,040,080 A * 5/1936 Collins ..... 160/191
3,124,082 A * 3/1964 Larsen ..... 104/98

(Continued)

FOREIGN PATENT DOCUMENTS

EP 0737788 A 10/1996
FR 2501267 A 9/1982

(Continued)

OTHER PUBLICATIONS

Mexican Patent Application No. MX/a/2009/010414; First Office Action; Apr. 26, 2012; 8 pages.
Mexican Patent Application No. MX/a/2009/010414; Second Office Action; Dec. 7, 2012; 6 pages.

*Primary Examiner* — Alvin Chin-Shue
(74) *Attorney, Agent, or Firm* — Whye Hirschboeck Dudek S.C.

(57) ABSTRACT

A system and method for a scaffold deck with a fall arrest assembly is disclosed. The fall arrest assembly comprises a deck structure (102) and a rail assembly (122) for permitting an individual to tie-off in a manner that permits the individual with a range of motion along the deck structure. The fall arrest assembly further includes an uplift hook mechanism (120) connected to or otherwise installed on the deck structure such that the uplift hook mechanism is employed for both securing the deck structure to and releasing the deck structure from at least one supporting member. A plurality of deck hooks (118) connectable to or otherwise installed on the decking structure for connecting the decking structure to the supporting member is additionally provided. A deck latch assembly located connected to the uplift hook mechanism additionally facilitates connection of the deck structure to a second deck structure.

14 Claims, 12 Drawing Sheets

(56) References Cited

U.S. PATENT DOCUMENTS

| | | | | |
|---|---|---|---|---|
| 3,349,720 | A * | 10/1967 | Pender | 104/173.2 |
| 5,141,078 | A | 8/1992 | Wood | |
| 5,279,193 | A | 1/1994 | Huffine | |
| 5,704,449 | A * | 1/1998 | Ono | 182/119 |
| 6,076,991 | A | 6/2000 | Karlsen | |
| 6,520,290 | B1 * | 2/2003 | Carter | 182/36 |
| 2001/0004823 | A1 | 6/2001 | Cronin et al. | |

FOREIGN PATENT DOCUMENTS

| | | | |
|---|---|---|---|
| GB | 2158497 | A * | 11/1985 |
| JP | 01187257 | A | 7/1989 |
| JP | 02149050 | U | 12/1990 |
| JP | 09004216 | A | 1/1997 |

* cited by examiner

FIGURE 6A
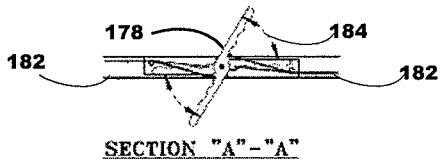
FIGURE 6B
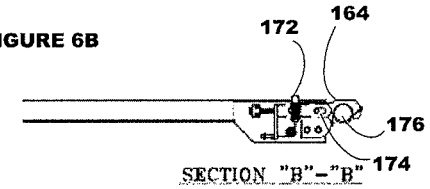
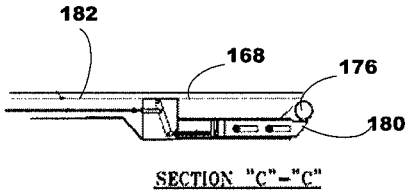
FIGURE 6C

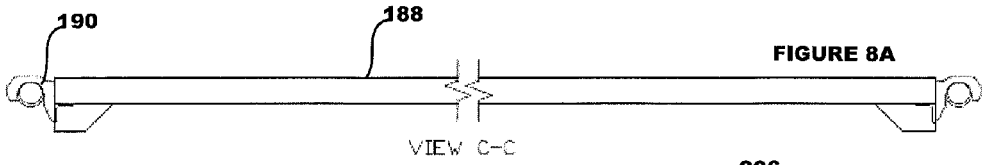
FIGURE 8A
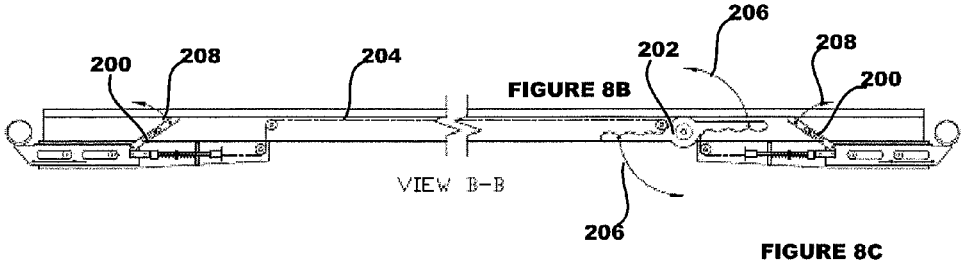
FIGURE 8B
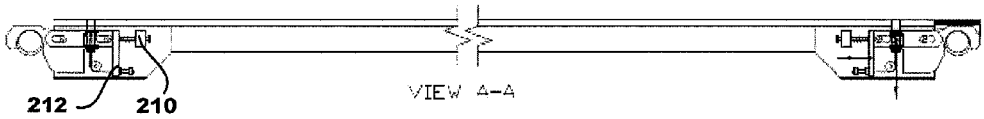
FIGURE 8C
FIGURE 8D
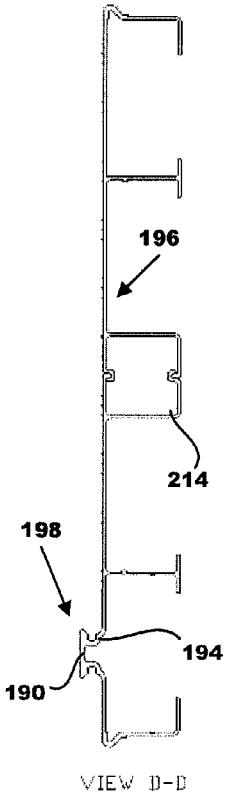
FIGURE 8E
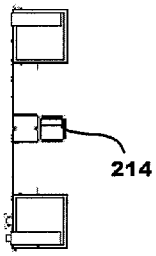

216
100/160/186
222
224
218

100/160/186
216
222
224
218

ERECTOR SCAFFOLD DECK FALL ARREST ASSEMBLY

CROSS-REFERENCE TO RELATED APPLICATIONS

This application claims the benefit of U.S. Provisional Application No. 60/909,316 filed Mar. 30, 2007, the subject matter of which is incorporated in its entirety by reference herein.

FIELD OF THE INVENTION

The present invention relates to scaffold work platform systems and, more particularly, to deck structures and fall arrest mechanisms employed in such scaffold work platform systems.

BACKGROUND OF THE INVENTION

When erecting a scaffold, each level is typically completed before moving up to construct the next level. This may involve moving large quantities of scaffold equipment up hundreds of feet horizontally along a level, until that level is completed. A lead erector in a scaffold crew typically has to move along the length of a scaffold prior to installation of fall protection equipment (e.g., guard rails, gates, etc.). Many companies mandate total or 100% tie-off, meaning the erector must have the hook to his fall arrest harness attached to an anchor point 100% of the time. This can typically be accomplished by using hooks for each harness and hooking each one to an anchor point further down the scaffold run, then returning back and unhooking the first hook from the first anchor point. If the worker neglects to tie off, or ties off to an anchor point that cannot take the load imposed by a fall, the worker is vulnerable to injury.

A lead erector in a scaffold crew typically stands on a scaffold before the installation of any fall protection or arrest devices (e.g., guard rails, gates, etc.). Traditionally, such individuals (e.g., lead erectors) used lanyards hooks attached to fall arrest harnesses or the like to any available (and not necessarily suitable) anchor or securing point. Such anchoring points included the scaffold itself, the building adjacent to which the scaffold was typically positioned, or the like, with the intent being to use this point as a fall arrest anchor. However, buildings may not have suitable anchor points, that is, anchor points that can be accessed from the scaffold itself. Moreover, the scaffold itself is typically not designed to serve as a fall arrest anchor, anchor point, or anchor structure.

Accordingly, it would be desirable to provide a safe yet convenient to use fall arrest anchoring assembly. Additionally, it would be desirable to provide for an assembly that can be incorporated into scaffolds themselves, providing automatic, continuous tie-off. Ideally, such a fall arrest system or assembly would provide a fall arrest anchor point that could allow tying off in advance of a lead erector climbing on a scaffold assembly, or up to a next level of the assembly. Furthermore, it would be desirable if the assembly were easy to use, for example by providing for easy installation (e.g., during engagement or disengagement of the assembly).

SUMMARY OF THE INVENTION

In one aspect, the present invention relates to a fall arrest assembly comprising a deck structure and a rail assembly in operable association with the deck structure. The rail assembly permits an individual to tie-off in a manner that permits the individual with a range of motion along the deck structure while being tied-off. The fall arrest assembly further includes a first uplift hook mechanism connected to or otherwise installed on the deck structure such that the first uplift hook mechanism is employed for both securing the deck structure to and releasing the deck structure from at least one supporting member.

In another aspect, a fall arrest assembly comprising a decking structure is provided. In at least some embodiments, the fall arrest assembly further includes a rail assembly in operable association with the decking structure, which permits an individual to tie-off in a manner that permits the individual with a range of motion along the deck structure. Also provided in the fall arrest assembly is a first uplift hook mechanism connectable to the decking structure for engaging to and/or disengaging from a supporting member. A plurality of deck hooks connectable to or otherwise installed on the decking structure for connecting the decking structure to the supporting member is additionally provided. The fall arrest assembly additionally comprises a deck latch assembly that is connected to the first uplift hook mechanism for facilitating connection of the deck structure to a second deck structure.

In yet another aspect, a method of installing a fall arrest assembly is provided. The method comprises providing (i) a deck structure; and (ii) a rail assembly in operable association with the deck structure. The method further comprises locating an anchor point on the rail assembly. The method additionally comprises climbing onto the deck structure. Further, the method comprises attaching one or more lanyard mechanisms to the anchor point on the rail assembly to provide a range of movement on the deck structure when erecting a scaffold assembly.

Various other aspects, objects, features and embodiments of the present invention are disclosed with reference to the following specification, including the drawings.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The drawings illustrate a best mode presently contemplated for carrying out the invention. The invention is capable of other embodiments or of being practiced or carried out in other various ways. Like reference numerals are used to indicate like components. In the drawings:

FIGS. 6A-6C show enlarged sectional views taken along lines "A-A", "B-B" and "C-C" of FIG. 5, respectively, and showing portions and specific components of the fall arrestor assembly in accordance with at least some embodiments of the present invention;

FIGS. 8A-8E show enlarged sectional views taken along lines "A-A", "B-B", "C-C", "D-D" and an end view of FIG. 7, respectively, and showing portions and specific components of the fall arrestor assembly in accordance with at least some embodiments of the present invention.

DETAILED DESCRIPTION OF THE PREFERRED EMBODIMENTS

Figure 1:
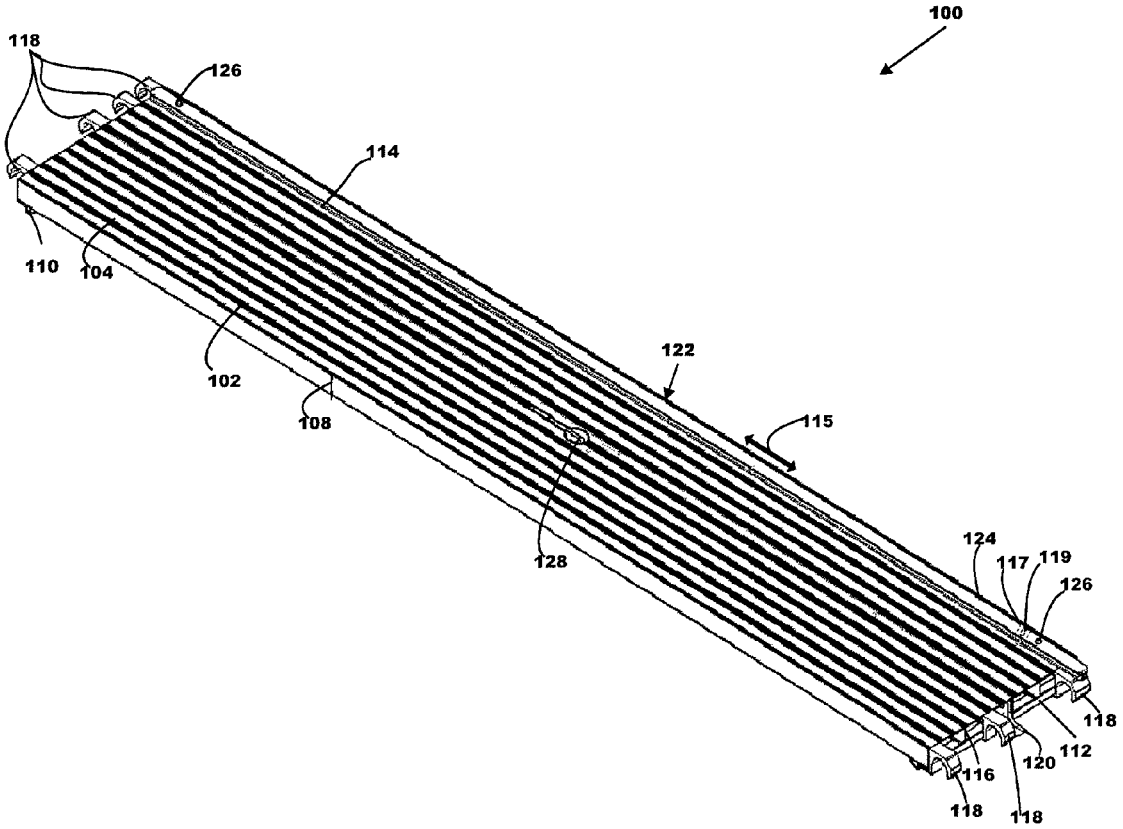
FIG. 1 illustrates a perspective view of a fall arrestor assembly in accordance with at least some embodiments of the present invention.

Referring to FIG. 1, a perspective view of a fall arrest tie-off assembly 100 is shown in accordance with at least some embodiments of the present invention. The fall arrest tie-off assembly 100 is also referred herein as a fall arrest anchor assembly, fall arrest/arrestor assembly, arrest/arrestor assembly, a work-access system, erector tie-off plank assembly, erector scaffold deck fall arrest assembly and the like. As shown, the fall arrest assembly 100 includes a deck structure 102 (also referred herein as decking, decking structure, plank and the like) having a top surface 104 and a bottom surface 106 (See FIG. 4) separated by a thickness 108 and bounded by end cap portions 110 and 112. In at least some embodiments, the top and the bottom surfaces 104 and 106, respectively, can have a variety of longitudinal corrugations 114 for increasing the strength of the deck structure and for providing a safe walking surface for workers working on the fall arrest assembly 100.

Notwithstanding the fact that the present embodiment illustrates longitudinal corrugations, in other embodiments, any type of corrugations, grilles, webs, lattices, etc. can be provided in one or both of the top and the bottom surfaces 104 and 106, respectively. Any of the aforementioned corrugations can additionally be provided on the thickness 108 as well. Furthermore, although in some embodiments, the deck structure 102 can have a hollow core 116, this need not always be the case. Rather, in other embodiments, the deck structure can have a solid core or any other type of core that may be deemed suitable. Additionally, the thickness 108 can vary depending upon the embodiment of the invention based upon, for example, the load handling capability requirements of the scaffold work platform system employing the fall arrest assembly 100.

Further, in the present embodiment, the deck structure 102 has a length of about 10' or 7' and a width of about 19" and is constructed out of aluminum (e.g., non-skid extruded aluminum). In some embodiments, when the deck structure 102 is made out of non-skid extruded aluminum, the weight of the deck structure can be about 40 lbs (pounds) when the length is about 7' and about 50 lbs when the length is about 10'. Further, in some alternate embodiments, it has been found that the present fall arrestor assembly 100 can withstand an impact load transmitted to a harness during a fall arrest of up to about 1800 lbs. Notwithstanding the aforementioned configuration of the deck structure 102, it is contemplated that the sizes, shapes and the load bearing/transmitting capabilities of the fall arrestor assembly 100, including the decking structure 102 can vary without departing from the spirit and scope of the invention.

A plurality of deck hooks 118 are connected or otherwise installed at least partially on the end cap portions 110 and 112 of the deck structure 102. The deck hooks 118 permit the deck structure 102 to be supported at each end by a scaffold tube or tube-like component (not shown) of the scaffold work platform system that is typically horizontally-disposed to support the deck structure in a level fashion. In at least some embodiments, the deck hooks 118 are constructed of aluminum (e.g., solid aluminum). By virtue of constructing the deck structure and the deck hooks of aluminum, a light weighted yet strong fall arrest assembly 100 is provided. Nevertheless, in other embodiments, one or both of the deck structure 102 and the deck hooks 118 can be made of any of a variety of metals, including other rigid materials such as wood. Additionally, the presence of four deck hooks 118 on the end cap portion 110 and three hooks on the end cap portion 112 in the present embodiment is merely exemplary. In other embodiments, any number of deck hooks 118 as may be deemed necessary for securely connecting the deck structure 102 to the scaffold tube can be employed.

In addition to the deck hooks 118, the fall arrestor assembly 100 includes an uplift hook or hook mechanism 120 connected at least partially to the end cap 112 and the deck structure 102 for securing the fall arrestor assembly 100, and particularly the deck structure, to the scaffold tube member. In at least some embodiments of the invention, at least two uplift hook mechanisms are included in the fall arrestor assembly 100 and positioned at opposite ends of the deck structure 102 to facilitate connection to other fall arrestor assemblies and/or decking structures. Additional details regarding the uplift hook 120 will be provided in regards with FIGS. 2 and 3.

Also provided on the deck structure 102 is a rail assembly 122 for providing a fall arrest system for ensuring the safety of the worker(s) working on the fall arrestor assembly 100, and additionally for arresting the fall should a worker happen to fall. The rail assembly 122 includes a rail mechanism 124 disposed on and running lengthwise on the top surface 104 of the deck structure 102. The rail assembly 120 including the rail mechanism 124 will be described in greater detail in FIG. 2. A traveler mechanism 117 (also referred herein as traveler, traveler car, car mechanism or traveler car mechanism) can additionally be engaged to, or otherwise fitted over or with respect to the rail mechanism 124, in a manner well known, for moving the traveler 117 in a direction 115 with respect to the rail mechanism.

In at least some embodiments, the traveler 117 is in rolling engagement with the rail mechanism 124. In other embodiments, the traveler 117 can be an anchor device constructed out of, for example, aluminum, and having ball bearings for mounting and moving the traveler on the rail mechanism 124. Notwithstanding the fact that a particular shape, size and configuration of the traveler 117 is shown, it is nevertheless an intention of this intention to include a variety of traveler mechanisms suitable for anchoring to the rail mechanism 124 in a movable manner.

Figure 2:
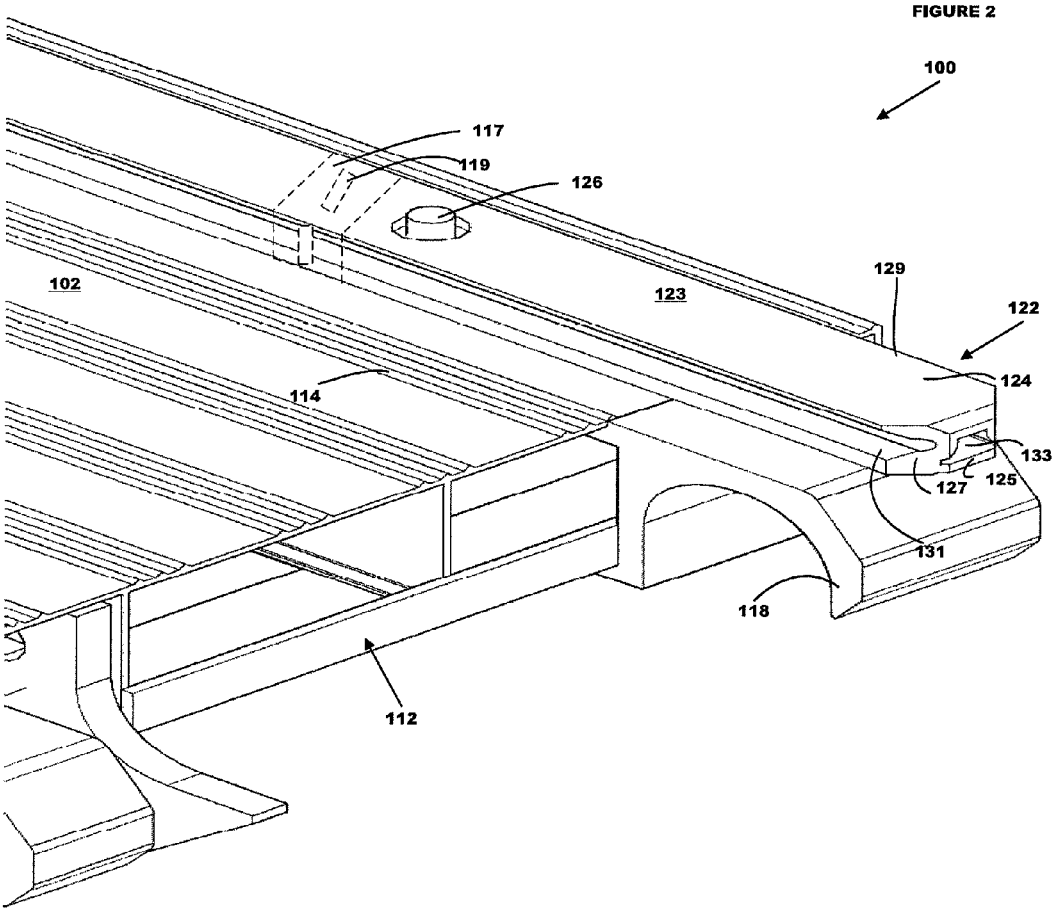
FIG. 2 illustrates an enlarged perspective view of a portion of the fall arrestor assembly of FIG. 1 in accordance with at least some embodiments of the present invention.

In at least some additional embodiments, the traveler 117 can have one or more loops 119 (also referred herein as hooks, latch, latching mechanism etc.) for attaching a safety harness (e.g., lanyard—not shown) of a worker to the traveler for arresting motion in the event of a fall of the worker. Typically, the loops 119 can be any of variety of loops that are commonly available and frequently employed in scaffold systems. Further, the positions of the loops 119 on the traveler 117 can vary. For example, in at least some embodiments, the loops can be positioned on the top surface of the traveler. In other embodiments, the loops 119 can be positioned on a side surface thereof. In yet other embodiments, multiple loops including, for example, one loop on the top surface and one loop on the side surface, can be present, as shown in FIGS. 1 and 2. Additionally, the shape and size of the loops 119 can vary depending upon, for example, the shape and size of the safety harness and lanyard employed for engaging with the loops and the arrangement of the scaffold work platform system.

Therefore, the traveler 117 provides a mobile anchor device for serving as a latching point (e.g., via the hooks 119) to ensure safety of a worker. It should be understood that the terms moving, rolling, engaging, fitting, etc. are intended to have a broad interpretation and can encompass any of a variety of fit or connection means for providing easy sliding movement along the rail mechanism 124 in any direction. The rail assembly 122 additionally includes one or more stops or stop mechanisms 126 (e.g., one or more stop pins), described below, that are in operable association with (e.g., built into) the rail or rail mechanism 124 to limit removal and or travel/motion of the traveler 117 with respect to the rail mechanism.

Also shown in FIG. 1 is a deck latch assembly 128 (also referred herein as latch assembly, latch, and the like) that is used for securely connecting one fall arrestor assembly 100 to another fall arrestor assembly. The deck latch assembly 128 is shown and described in greater detail with respect to FIG. 4. As illustrated in FIG. 1, in at least some embodiments, the deck latch assembly 128 can generally located in a center or central region of the deck structure 102 and typically connected to the uplift hook mechanism 120. In at least some embodiments, the deck latch assembly 128 is connected to both of the uplift hook mechanisms 128, although in other embodiments, the deck latch assembly can be connected to a single uplift hook mechanism as well. In other embodiments, the positioning of the deck latch assembly 128 can vary. For example, in at least some embodiments, the deck latch assembly 128 may be positioned at an end of the deck structure 102. Other positions and orientations of the deck latch assembly 128 depending upon the arrangements of the scaffold assembly are contemplated and considered within the scope of the invention.

Notwithstanding the configurations, dimensions and profiles of the various components of the fall arrestor assembly 100 described above, it is an intention of this invention to encompass additional components including various refinements to the previously described components. For example, in other embodiments, various handle structures, support structures etc. can be provided. In alternate embodiments, components other than those described above can be present as well. Further, the shapes, sizes and numbers of the various components of the fall arrestor assembly 100 can vary to convenience. By virtue of providing the fall arrestor assembly 100 having the deck hooks 118, the uplift hook 120 and the rail assembly 122, the present invention advantageously provides a work platform system in which the decking structure 102 can be installed and/or removed conveniently by a single individual, called a "lead erector".

Turning now to FIG. 2, an enlarged perspective view of a portion of the fall arrestor assembly 100 of FIG. 1 is shown, in accordance with at least some embodiments of the present invention. As shown, the fall arrestor assembly 100 includes the deck structure 102 bounded by the end cap portions 110 (See FIG. 1) and 112 and further having the plurality of deck hooks 118 for securing the decking to the scaffold structure (e.g., tubular scaffold) of the scaffold work platform system. Also shown is the rail assembly 122 in operational association with the deck structure 102 and including the rail mechanism 124 and the stops or stop pin mechanism(s) 126 for limiting removal and/or travel of the traveler 117 that is in association with the rail mechanism.

With respect to the rail mechanism 124 in particular, it includes one or more rail, rail-like structures or possibly beams and tracks that are disposed on, or otherwise attached to, the top surface 104 of the deck structure 102 at an edge thereof. In at least some embodiments, the rail(s) of the rail mechanism 124 can be removably connected to the deck structure by any of a variety of fastening and/or engaging mechanisms in a known manner. In other embodiments, the rail mechanism 124 can be integrally formed, in a raised or a recessed portion of the deck structure itself thereby providing a rail or rail-like mechanism for receiving a traveler 117 or other movable tie-off apparatus. Additionally, in some embodiments, the rail mechanism 124 can be constructed of steel, although other metal or rigid materials can be employed as well. It should be understood that the shape, size and material of construction of the rail mechanism 124 can vary to convenience. Furthermore, the term "rail" is intended to have a broad meaning including any elongate structure to which the traveler 117 can be attached for sliding/moving along the rail.

Additionally, although in the present embodiment the rail mechanism 124 is shown to be disposed longitudinally (lengthwise) on the deck structure 102 at an edge thereof, in other embodiments, the orientation of the rail mechanism can vary. For example, in some embodiments, the rail mechanism 124 can be disposed horizontally along the edge of the deck structure. Alternatively, in some embodiments, the rail mechanism 124 can be disposed in a central (or substantially central) portion of the deck structure 102. In alternate embodiments, other orientations are intended to be encompassed within the scope of the invention. Further, the rail mechanism 124 can be a separate component that is connected directly or indirectly to the deck structure by any of a variety of engaging or fastening mechanisms. Alternatively, in alternate embodiments, the rail mechanism 124 can be integrally formed with the deck structure 102, or integrated within or with respect to the deck structure itself.

With respect to the structure of the rail(s) (also referred herein as rail-like mechanism, beam or track) in particular, any suitable structure with or without various channels, grooves and contours can be employed. For example, in the present embodiment, the rail mechanism 124 has first and second surfaces 123 and 125, respectively, parallel to the top surface 104 of the deck structure 102, the first and the second surfaces being connected by third and fourth side surfaces 127 and 129, respectively. Further, as shown, one or both of the third and the fourth surfaces 127 and 129, respectively, can have channels or grooves 131 for securely fastening the traveler 117 to the rail mechanism 124. In at least some embodiments; the first and the second surfaces 123 and 125, respectively, can also have various grooves and channels for providing various latching positions, both from above and below the deck structure 102. By virtue of providing a rail mechanism 124 having grooves and channels, the traveler 117 can be prevented from moving in a direction transverse to the direction of the rail mechanism. An optional orifice 133 passing through at least a portion of the rail mechanism 124 can be provided in some embodiments to reduce the overall weight of the rail assembly 122. Other components including, for example, locking mechanisms for holding the traveler 117 and the loops 119 in position can additionally be employed. Various other components can also be used in conjunction with, or as part of the rail mechanism 124 without departing from the scope of the invention.

Further, as indicated earlier, the stops or stop pins 126, in accordance with at least some embodiments, move in a vertical fashion when the decking structure is placed and secured with regard to a scaffold assembly in a level horizontal fashion. In this way, the one or more of the stop pins 126 extend and/or retract to limit removal and/or motion of the traveler 117 that is in association with the rail mechanism 124. In at least some embodiments, the stop or stop pins 126 have a default position that is in the extended (stop) position. In other embodiments, it is contemplated that the traveler 117 to which a harness of an individual (e.g., a lead erector) is connected to arrest a fall, remains between to extended stop pin mechanisms 126 so as to limit the movement of a traveler car. In alternate embodiments, the one or more stops or stop pins 126 are in an extended (stop) position when the decking or plank structure 102 is not connected to or installed at a given end of the decking structure 102. In further embodiments, the stops or stop pin mechanisms 126 automatically retract or recede into the rail, for example, below the top surface 123 of the rail mechanism 124 when another decking structure is connected to decking structure 102 in end-to-end fashion, so as to permit an installer to move out onto the next, connected decking structure. And in yet other embodiments, the one or more stops or stop pin mechanisms 126 are to extend once again in, for example, a stop position, when such a second deck is removed from its end-to-end position.

Figure 3:
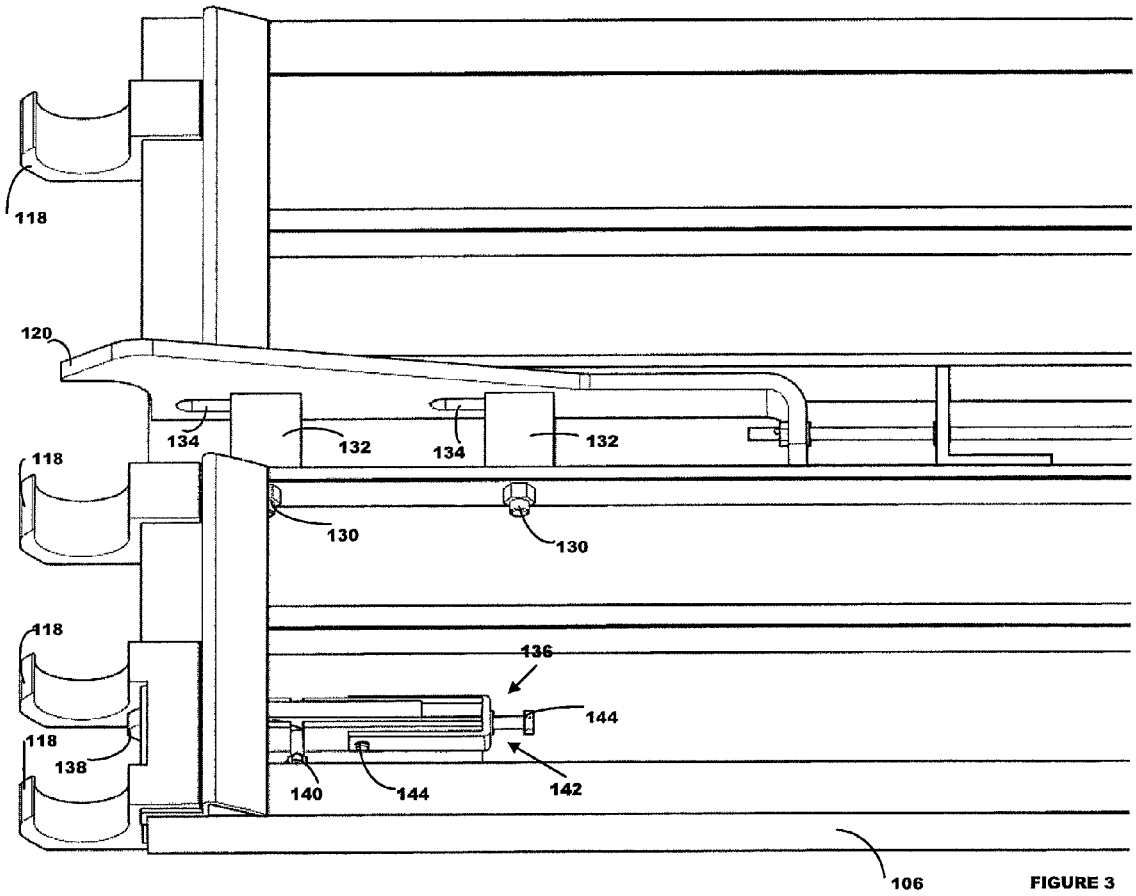
FIG. 3 illustrates an enlarged, bottom end view of the underside of the fall arrestor assembly of FIG. 1 in accordance with at least some embodiments of the present invention.

Turning to FIG. 3, an enlarged, bottom end view of the bottom surface (or underside) of the deck structure 102 showing the uplift mechanism 120 and the stop mechanism 126 (See FIG. 2) in greater detail is shown in accordance with at least some embodiments of the present invention. As shown, in at least some embodiments of the invention, the uplift hook mechanism 120 is located at a central or substantially central portion of the deck structure 102 substantially in-line with the deck latch assembly 128 (shown in FIG. 4). Additionally, the uplift hook mechanism 120 is positioned such that it protrudes from one end of the deck structure 102 for contacting an underside of the scaffold tube member, which as previously mentioned is typically horizontally disposed with respect to the deck structure. In at least some embodiments, the uplift hook mechanism 120 is connected to the deck structure 102 via bolts 130 passing through the uplift hook mechanism and structural element 132. Generally, to accord stability to the uplift hook mechanism 120, a plurality of structural elements 132 connecting the uplift hook mechanism to the deck structure 102 via the bolts 130 are present. For example, in the present embodiment, two structural elements 132 connecting the uplift hook mechanism 120 to the deck structure 102 are shown. Nevertheless, in other embodiments, more than two, or potentially a single structural element for connecting the uplift hook mechanisms to the deck structure 102 can be employed depending upon the length of the deck structure and the dimensions of the uplift hook mechanism 120.

In addition, in at least some embodiments, the uplift hook mechanism 120 is spring-loaded such that the uplift hook mechanism can retract as the deck structure 102 is being installed, and once a deck structure is properly positioned, the hook mechanism can lock into place, thereby securing the decking structure to the scaffold. To enable the uplift hook mechanism to contract and retract by virtue of the spring mechanism without interference from the structural elements 132, the uplift hook mechanism 120 is provided with slots 134 through which the structural elements are connected to the uplift hook mechanism. It can further be appreciated that although a single uplift hook mechanism 120 is shown in FIG. 3, multiple uplift hooks mechanisms, having similar or substantially similar configurations and orientations to the uplift hook mechanism 120 described above, can be present in other embodiments. When two such uplift hook mechanisms 120 are utilized (e.g., at each end of the deck structure 102), it is contemplated that the uplift hook mechanisms are both locked (e.g., in some embodiments, in an extended position) under the scaffold (e.g., scaffold header) to secure the deck structure to the scaffold.

Also shown in FIG. 3 is a stop pin assembly 136, which is used to actuate the stop mechanism 126 (See FIGS. 1 and 2). The stop pin assembly 136 includes a stop pin plunger mechanism 138, which actuates the stop pin mechanism 126 when the deck structure 102 is connected to or disassembled from another deck structure. The stop pin assembly 136 further includes a stop pin guide mechanism 140 for guiding the stop pin mechanism 126 during extension and retraction. The stop pin assembly 136 including the stop pin plunger mechanism 138 and the stop pin guide mechanism 140 is attached in operational association with the bottom surface 106 of the deck structure 102 via bracket 142 and bolt 144. Notwithstanding the particular arrangement of the stop pin assembly 136 described above, in other embodiments, the arrangement and configuration of the various components of the stop pin assembly can vary.

Figure 4:
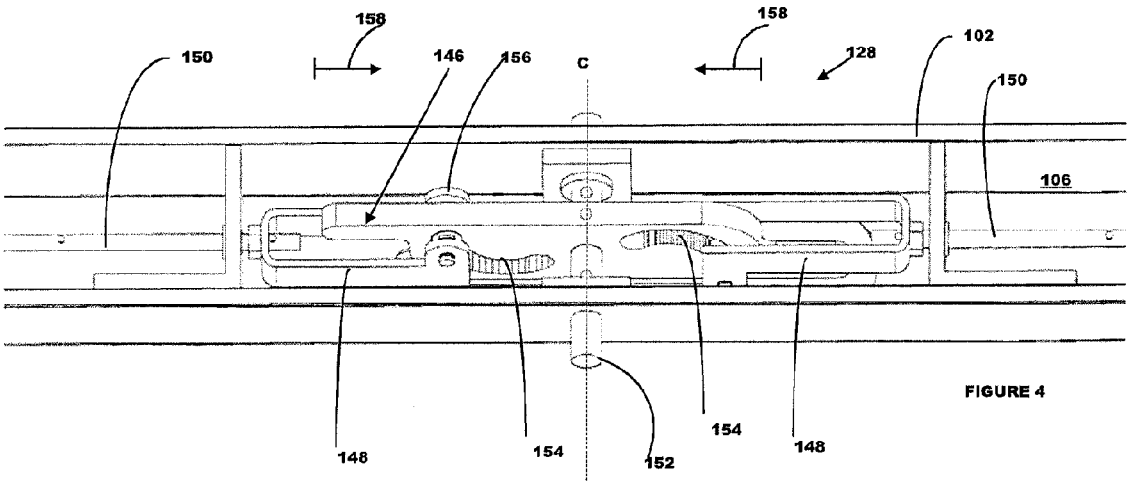
FIG. 4 illustrates an enlarged bottom view of a portion of the fall arrestor assembly in accordance with at least some embodiments of the present invention.

Turning now to FIG. 4, an enlarged bottom view of a portion of the fall arrestor assembly 100 showing the deck latch assembly 128 including various associated components/features is shown in accordance with at least some embodiments of the present invention. The deck latch assembly 128 comprises a latch mechanism 146, a pair of shackle mechanisms 148, a pull rod mechanism 150 and an axle 152. The latch mechanism 146 includes, as shown, a recessed/slotted cam profile 154 on each of its sides so as to receive or accept pins or pin-like mechanisms 156 on one end (and for connecting) each shackle mechanism 148. Additionally, the latch mechanism 146 is rotatable, such that when so rotated, the pins 156 in the shackle mechanisms 148 are pulled in a direction that is, as illustrated, towards the center of the decking structure 102. The directions of movement are indicated by arrows 158 and the center of the decking structure is indicated by axis C (with dashed lines). The pull rod mechanism 150 is used to disengage the uplift hook mechanism(s) 128 (shown in FIGS. 1 and 3). Such engagement and disengagement of two deck structures causes the stop pin mechanisms 126 (shown, for example, in FIG. 2) to extend and/or retract as previously described. Therefore, the horizontal motion of the pull rod mechanism 150 is translated into a vertical motion of the stop pin mechanisms 126 for providing a continuous run, automatic and hands-free fall erector assembly 100. It should be understood that variations, such as the placement of the deck latch assembly 128, can vary to convenience and such variations are contemplated and considered within the scope of the present invention.

Notwithstanding the fact that in some embodiments, a recessed/slotted cam profile 154 for actuation of the latch mechanism 146 is provided, in other embodiments, other means/mechanisms for actuation/retraction of the latch mechanism can be employed as well. For example, in at least some embodiments, a rotatable drum, the rotation of which produces tension in the shackle mechanism 148 and the pull rod mechanism 150 to actuate the uplift hooks mechanism(s) 128, can be utilized. In alternate embodiments, other types of devices for actuating the uplift hooks mechanism(s) 128 can be employed without departing from the spirit and scope of the present invention. Additionally, the shackle mechanism 148 and the pull rod mechanism 150 can all vary in other embodiments. For example, in other embodiments, various other types of devices and structures achieving substantially similar functionality as the shackle mechanism 148 and the pull rod mechanism 150 can be utilized for extending/retracting the uplift hook mechanism(s) 128 by actuating the recessed/slotted cam profile 154 or other suitable device.

Figure 5:
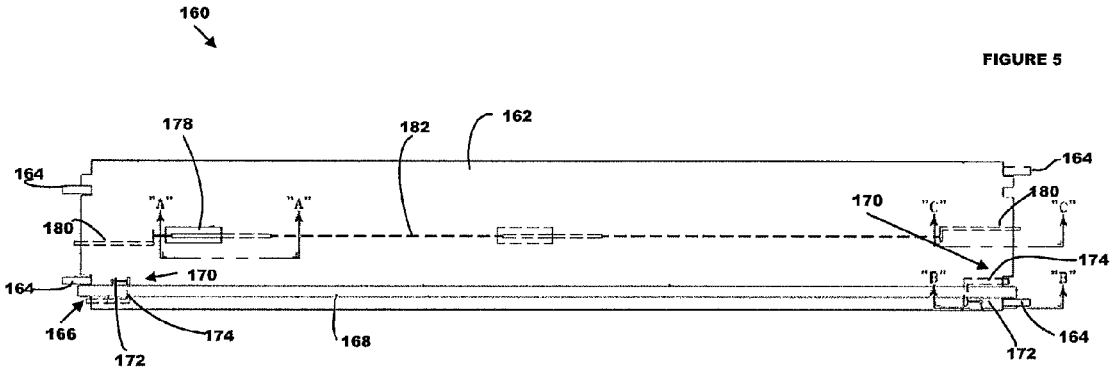
FIG. 5 shows a top view of another embodiment of the fall arrestor assembly in accordance with at least some embodiments of the present invention.

Referring now to FIG. 5, a top view of another fall arrestor assembly 160 (also called an "erector tie-off assembly") is shown in accordance with at least some embodiments of the present invention. FIGS. 6A-6C show enlarged sectional views taken along lines "A-A", "B-B" and "C-C" of FIG. 5, respectively, and showing portions and specific components of the fall arrest assembly 160. Referring to FIGS. 5 and 6A-6C, the fall arrestor assembly 160 includes a deck or decking structure 162 having a plurality of decking or deck hook mechanisms 164 disposed on its ends that permit the assembly 160 to be supported by scaffold mechanisms (e.g., scaffold tubes). A rail assembly 166 having a rail or rail mechanism 168 runs lengthwise along the deck. As indicated earlier, any of a variety of rails, rail-like mechanisms and beams, each with or without various grooves and channels can be employed. A traveler car (not shown) can be connected to the rail 168 for moving along or on top of the rail (e.g., by rolling engagement), and a scaffold worker (e.g., lead erector) can then connect (e.g., tie-off) a safety harness to the traveler car. By virtue of connecting the traveler car to the rail mechanism 168, the present invention provides an erector assembly that permits a wide range of movement on the deck structure 162 when building a scaffold.

Further, as indicated previously, the range of motion of the traveler car is only limited or constricted by one or more of the stop pin assemblies 170. In at least some embodiments, the stop pin assemblies 170 include stop pins or stop pin mechanisms 172, which serve to physically stop the travel car (again not shown) from moving past a given location of the stop pin, for example when, as described above, the stop pins are in an extended position. The stop pin assemblies 170 each further include an activation switch or activation switch mechanism 174. As shown, at least in part, in FIG. 6B, when the erector assembly 160, and specifically the deck hooks 164 of the decking structure 162 are connected with and supported by a scaffold member 176, activation switches 174 are used to activate or actuate the stop pin mechanisms 172. For example, and in accordance with at least some embodiments, when so positioned, the activation switch 174 can cause the stop pin mechanism 172 to automatically retract and thus permit the traveler car to have its range of motion extended to the adjacent decking structure/assembly. Alternatively, when removed from such a position relative to scaffold support 176, the activation mechanism 174 can be used to automatically extend the stop pin mechanism 172, thereby limiting the range of motion of the traveler care.

A handle or handle mechanism 178 can also be provided in some embodiments of the present invention. In some of these embodiments having the handle, the handle can be provided in a location that is centrally-disposed on the deck structure 162. In other embodiments, the handle 178 can be disposed on one end of the deck structure 162, as shown in FIG. 5. In alternate embodiments, the position of the handle 178 can vary. The handle 178 is connected to, as shown, to a pair of uplift hooks or uplift hook mechanisms 180, via activation cable or cables 182. With additional reference to FIGS. 6A and 6C, and as noted above with respect to a previous embodiment(s), rotation of the handle 178, indicated by rotational arrows 184, creates necessary tension on the activation cable(s) 182 to move uplift hook mechanisms 180. Such movement provides for the securing (e.g., during assembly) or separation of (e.g., during dismantling) of the uplift hook mechanisms 180 with respect to the supporting scaffold member(s) 176. In alternative embodiments, it is also contemplated that the handle 178 may be attached to a rotating cylinder or spool mechanism (not shown) to accomplish actuation or movement of the uplift hook mechanism(s) 180. Advantageously, the size and location of the handle mechanism 178 and the presence of the activation switch 174 permits a single erector to accomplish this activity and, typically, in single-handed fashion.

Figure 7:
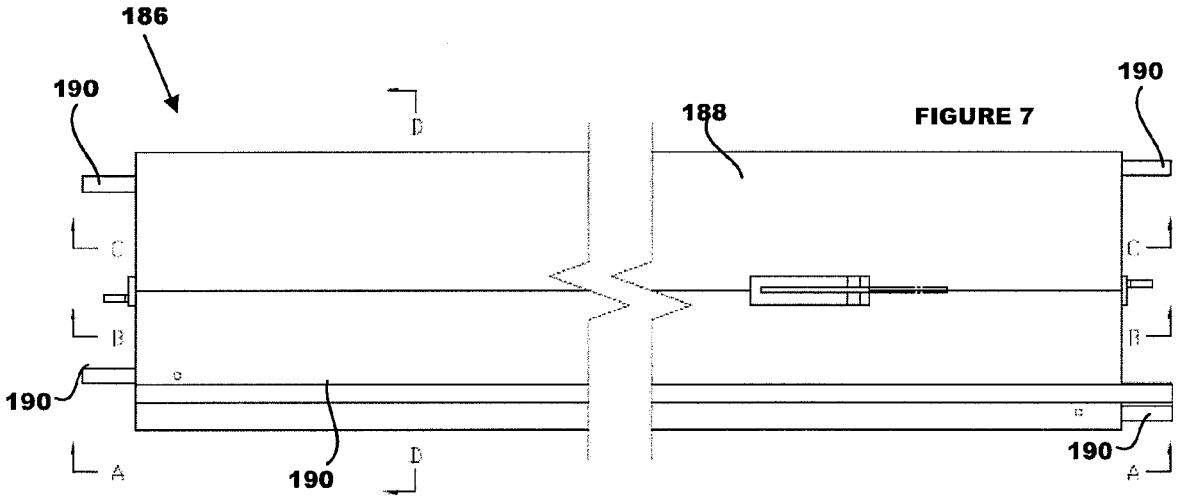
FIG. 7 shows a top view of the fall arrestor assembly in an alternate embodiment in accordance with at least some embodiments of the present invention.

Referring now to FIG. 7 an alternate embodiment of a fall arrest assembly 186 is shown in accordance with at least some embodiments of the present invention. FIGS. 8A-8E show enlarged sectional views taken along lines "A-A", "B-B", "C-C", "D-D" and an end portion of FIG. 7, respectively, and showing portions and specific components of the fall arrest assembly 186. Referring to FIGS. 7 and 8A-8E, the fall arrest assembly includes a deck structure 188 having a plurality of decking or deck hook mechanisms 190 disposed on its ends that permit the assembly 188 to be supported by scaffold mechanisms (e.g., scaffold tubes). The deck structure additionally includes a rail mechanism 192 that is integrally formed with the deck structure.

As further shown in FIG. 8D, the rail mechanism 192 is disposed on a raised surface 194 of the deck structure 188 resulting in a deck portion 196 and a rail portion 198. In at least some other embodiments, the surface 194 of the deck structure 188 can be formed within a recess of the deck structure such that the rail mechanism 190 is disposed on the surface 194 within the recess. Additionally, the rail mechanism 190 can run lengthwise along the deck structure 188. Other orientations of the rail mechanism 190 are also contemplated and considered within the scope of the invention. Further, as indicated earlier, any of a variety of rails, rail-like mechanisms and beams, each with or without various grooves and channels can be employed. A traveler car (not shown) can be connected to the rail 190 for moving along or on top of the rail (e.g., by rolling engagement), and a scaffold worker (e.g., lead erector) can then connect (e.g., tie-off) a safety harness to the traveler car. By virtue of connecting the traveler car to the rail mechanism 190, the present invention provides an erector assembly that permits a wide range of movement on the deck structure 188 when building a scaffold.

Additionally, as shown in FIG. 7 and FIGS. 8A-8E, the fall arrest assembly 186 includes one or more uplift hook mechanisms 200 that are connected to each other via handle 202 and wire/activation cable 204. Upon activating the handle 202 by rotating in a direction illustrated by arrows 206, the uplift hook mechanisms are activated in a direction depicted by arrows 208 to attach or release the fall arrest assembly 186 to/from other deck structures. The activation of the handle 202 and the uplift hook mechanism 200 is similar in operation to that described above with respect to FIGS. 5 and 6A-6C. One or more stops or stop pin mechanisms 210 activated by one or more activation switches 212 can additionally be provided for use in conjunction with the rail mechanism 190 for limiting the travel of the traveler. Also shown in FIGS. 8D and 8E is a housing 214 for holding the various components of the fall arrest assembly 186. Additional components described above can also be present in the fall arrest assembly 186, with the structure and operation of those components closely mimicking the structure and operation of the components described above.

Turning now to FIGS. 9A-9H, installation and use of the fall arrest assembly during installation/erection of a scaffold platform is shown in accordance with at least some embodiments of the present invention. As shown, the fall arrest (or erector tie-off) assembly 100/160/186 is installed on the next level 216 above the current completed working level 218. One or more fall arrest anchor points are located on an anchor device (e.g., traveler car) that rides along a horizontal member (e.g., rail mechanism) on the assembly. Upon moving up to the next level, the lead erector 222 attaches one of his lanyard hooks 224 to the anchor device. There are stops located at the end of each continuous run of the horizontal member (e.g., rail mechanism) that serve to prevent the device from disengaging from the horizontal member. The anchor device is designed to traverse the horizontal member from deck to deck. As additional decks are installed end to end in line with the first deck, the horizontal members of each deck can automatically align with each other and allow the anchor device and the worker 222 to traverse the entire length of the deck. In this fashion, the lead erector 222 is continuously tied off to an anchor point, even while traversing the scaffold. If an adjacent assembly is removed, a locking mechanism engages which serves to prohibit the anchor device from becoming detached or otherwise disassembled from the horizontal member at that end. As the worker or erector 222 completes each successive level, including installation of fall protection components (e.g., guard rails, gates, etc.) the assembly is disengaged from its current position and installed on the level above. It is noted that the assembly/installation process can be reversed to accomplish dismantling/disassembly. The assembly will then typically be the last component removed from each successive level and then subsequently installed at the next level down as the scaffold is dismantled.

Figure 9A:
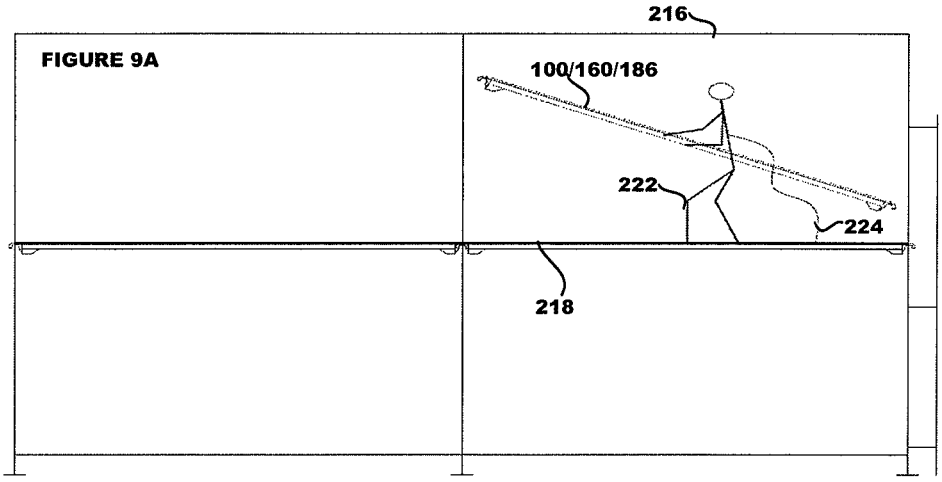
FIGS. 9A-9H illustrate in schematic form, a step-by-step method of installing and/or using the fall arrestor assembly in accordance with at least some embodiments of the present invention.
Figure 9B:
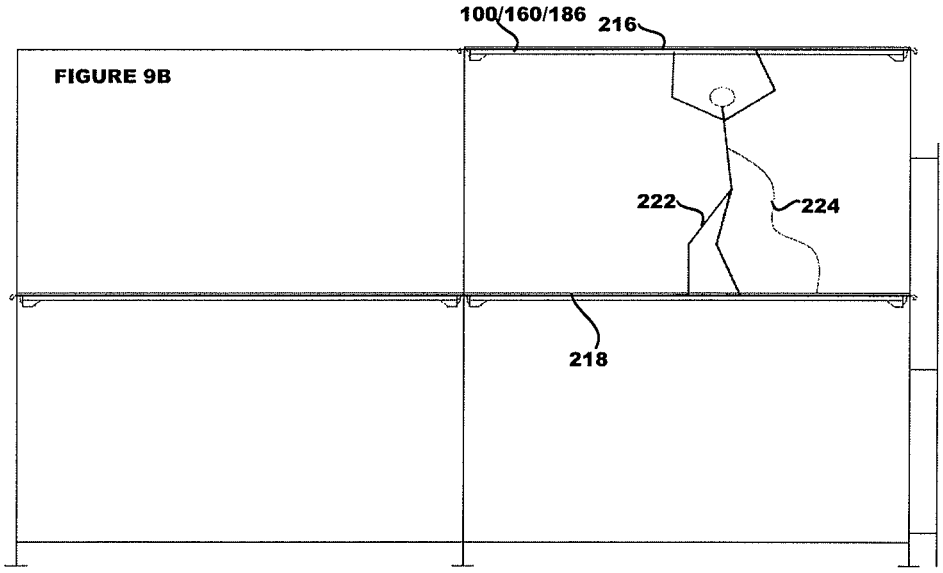
Figure 9C:
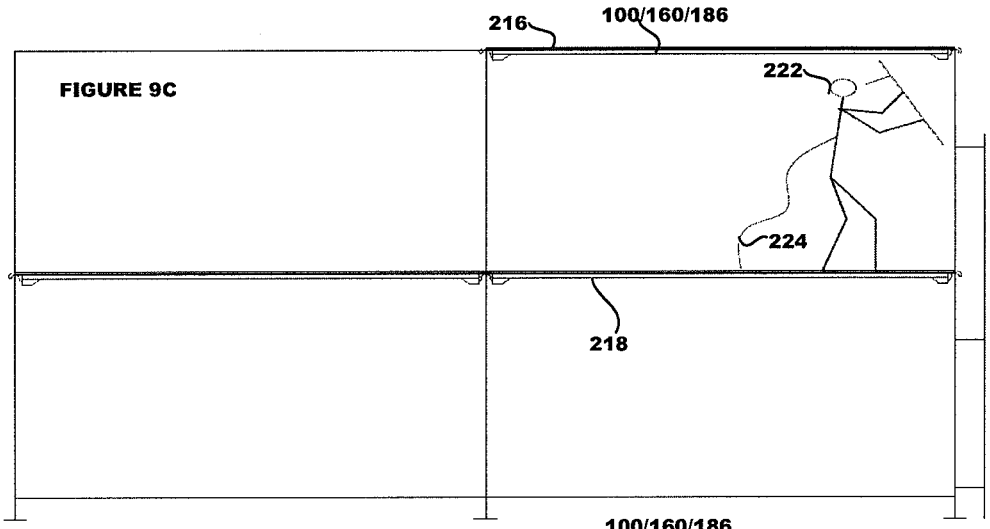
Figure 9D:
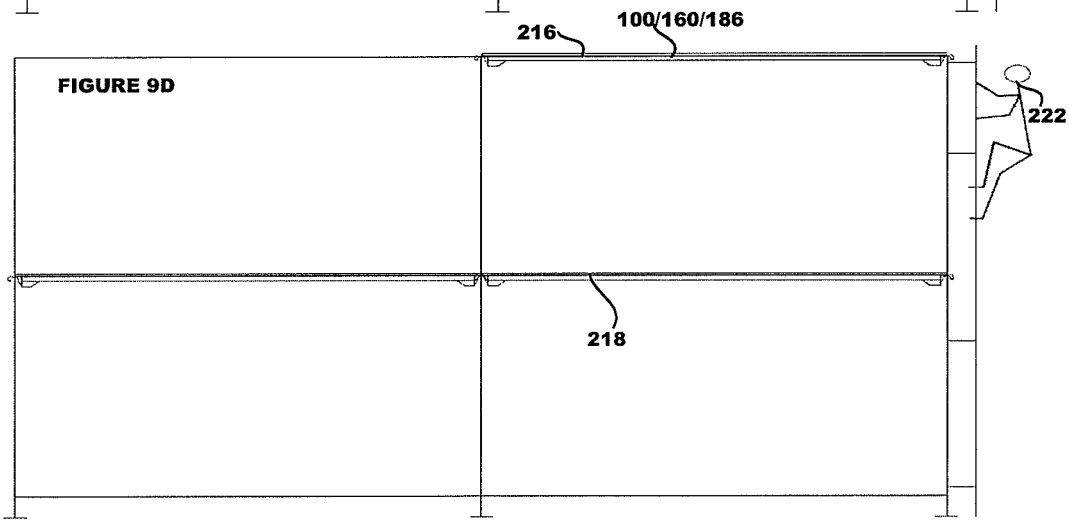
Figure 9E:
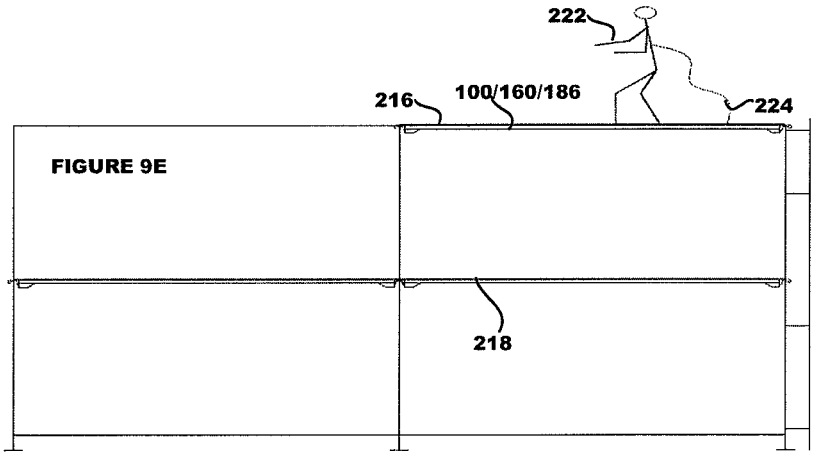
Figure 9F:
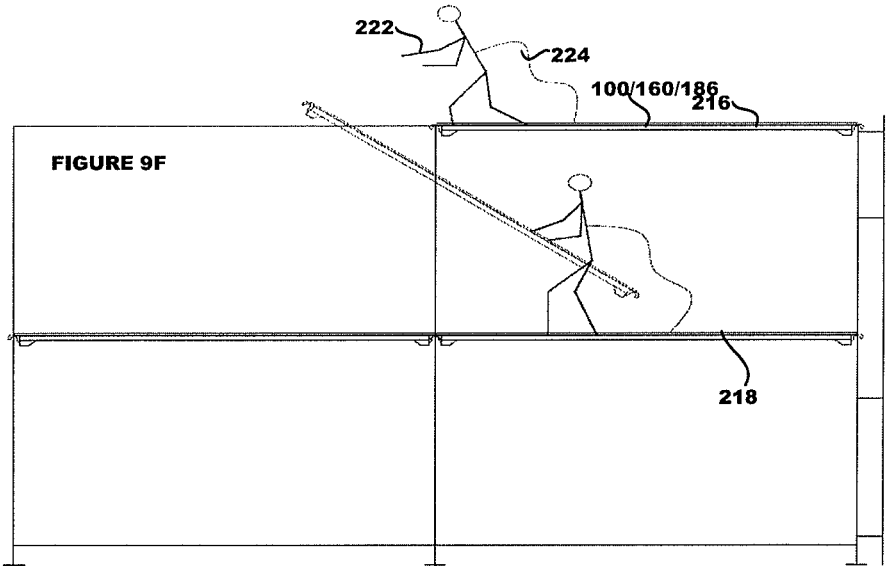
Figure 9G:
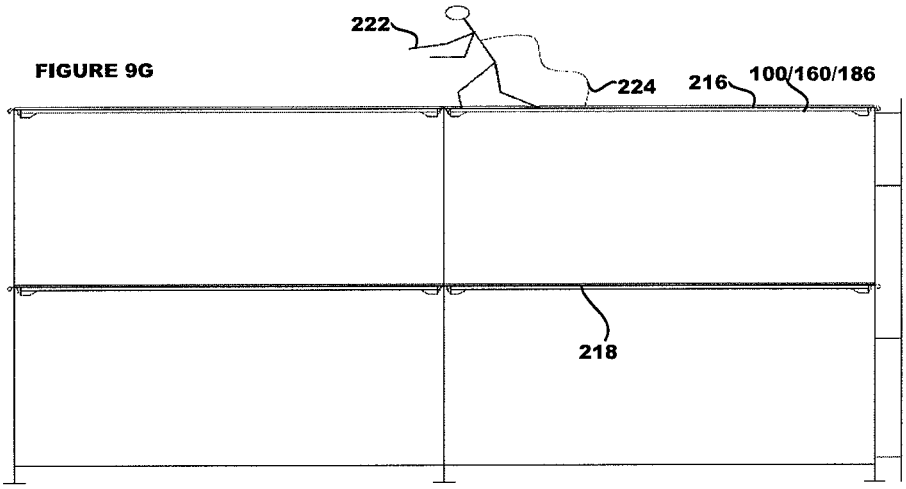
Figure 9H:
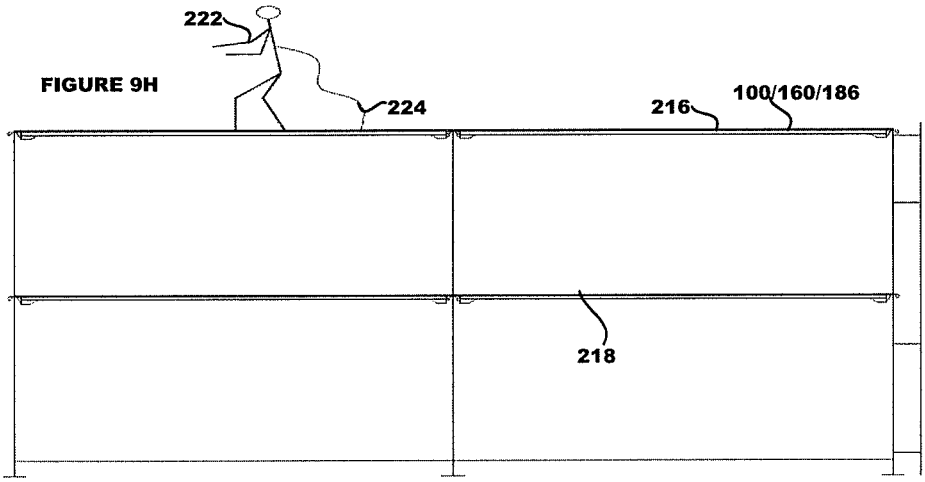

Therefore, the fall arrest assembly can be installed by a first worker as follows: the first worker first picks up and installs the fall arrestor tie-off plank assembly 100/160/186 on the next level 216 above the current working/completed level 218 on which the first worker 222 is positioned, as shown in FIGS. 9A and 9B. Then, the first worker 222 climbs up to the fall arrestor tie-off plank assembly 100/160/186 by utilizing a scaffold ladder 226, as shown in FIGS. 9C and 9D. A safety harness 224 (e.g., lanyard hook) of the first worker 222 is then attached to the traveler car mechanism on the rail assembly of the fall arrestor assembly 100/160/186 for providing a safe walking surface for the worker, as shown in FIG. 9E. Subsequently a second deck structure 228 can be installed. Typically, the installation of the second deck structure after installation of the current deck structure and the fall arrestor assembly is accomplished as follows: A second worker 230 from another level (e.g., the level 218 below) hands the first worker 222 the second deck 228 as shown in FIG. 9F. The second deck 228 is then placed end-to-end in line with the fall arrestor assembly, as shown in FIG. 9G. By virtue of installing the second deck structure in line with the current deck structure by way of the deck hooks, the stop pin mechanism is automatically activated due to the automatic operation of the uplift mechanism, thereby allowing the first worker to move freely along the length of both deck structures while being continuously tied off, as shown in FIG. 9H. The aforementioned steps of FIGS. 9A-9H are then repeated for installing additional decks.

Accordingly, provided herein is a hands-free, continuous run, fall arrest anchoring assembly. The assembly can be incorporated into scaffolds, providing automatic, continuous tie-off. The fall arrest system or assembly advantageously provides a fall arrest anchor point that allows tying off in advance of a lead erector climbing on a scaffold assembly and/or up to a next level of an assembly. By providing for or permitting single-handed operation, as well as other attributes that have been described or are apparent, the assembly is characterized by an ease use during, for example, both installation and dismantling of a scaffold assembly.

Notwithstanding the embodiments of the fall arrestor assembly 100 shown and described with respect to FIGS. 1-6C, the present invention is intended to encompass a variety of other features, including various refinements to the existing components. For example, although deck hooks are employed in the present embodiments for connecting the deck structure 102 to the scaffold tube, in other embodiments, other types of fastening mechanism can be employed. Relatedly, any of a variety of hooks having varying configurations, shapes and sizes as may be deemed suitable for securely connecting the deck structure 102 to the scaffold member can be employed as well. For example, the size of the deck hooks, and particularly, the engaging portion of the hooks can vary depending upon the diameter of the scaffold member engaged by way of the deck hooks. In at least some embodiments, the scaffold tube can have a diameter of 1.90" or 1.69". In other embodiments, the diameter of the scaffold tube can vary.

Furthermore, the shapes, sizes, configurations, profiles and material of construction of the various components can vary to convenience. For example, the shapes and sizes of the stop pin mechanisms can vary. Notwithstanding the fact that a cylindrical or substantially cylindrical stop pin is illustrated in the FIGS. described above, it is nevertheless an intention of this invention to include various shapes of the stop pin including, geometrical and non-geometrical shapes. Similarly, the shape of the deck structure can vary. In other embodiments, a rectangular deck structure need not be employed. Rather, other shapes and sizes as may be deemed suitable depending upon the application and the space constraints for installing a scaffold work platform assembly can be employed. Relatedly, size and configuration of other components of the scaffold work platform system can vary depending upon the embodiments and based upon the application.

Additionally, corrosion/rust resistant coatings can be provided on various components of the fall arrestor assembly for protecting the surfaces thereof. Other types of coating/protectants can be provided as well. Further, the fall arrestor assembly with respect to being utilized in a scaffold work platform assembly can be employed in a variety of applications. For example, the scaffold assembly can be used in various events including, for example, musical/theatrical events and staging events. In other embodiments, the scaffold assembly can be employed for supporting and/or carrying a wide variety of equipment. Additionally, the fall arrestor assembly can be temporarily or permanently installed for use with, in conjunction with or as part of the scaffold assembly. Further, the fall arrest assembly need not always be employed as part of a scaffold assembly. Rather, in at least some embodiments, the fall arrest assembly can be employed for various other purposes including, for example, railway construction wherein the fall arrestor assembly can be connected to the railway tracks for the safety of workers. In alternate embodiments, the fall arrest assembly can be put to other uses as well.

It is specifically intended that the present invention not be limited to the embodiments and illustrations contained herein, but include modified forms of those embodiments including portions of the embodiments and combinations of elements of different embodiments as come within the scope of the following claims.

We claim:

1. A fall arrest assembly for use in erecting a scaffold assembly comprising:

a decking structure configured for connection to at least one supporting members of the scaffold assembly, the decking structure comprising a top surface and a bottom surface extending between opposite ends thereof and separated by a thickness;

a rail assembly, the rail assembly including a rail that is positioned or formed on the top surface of the decking structure so that the rail extends lengthwise from one of the opposite ends to the other of the opposite ends on top of the decking structure, the rail assembly further including two stop pin assemblies disposed at opposite ends of the rail, each stop pin assembly having a pin and a corresponding activation switch operatively associated with the respective pin, wherein each stop pin assembly further comprises a stop pin plunger for actuating the stop pin when the decking structure is connected to or disassembled from another decking structure and a stop pin guide for guiding the stop pin plunger during extension and retraction thereof, the stop pin assembly being attached directly to the bottom surface of the decking structure;

a movable tie-off apparatus connected to, so as to travel along the rail to provide an anchor point to permit an individual to tie-off in a manner that permits the individual with a range of motion along the decking structure while being tied-off and to arrest a fall of the individual from the decking structure; and a first uplift hook mechanism connected to the decking structure, the first uplift hook mechanism for engaging to and/or disengaging from a respective one of the supporting members of the scaffold assembly;

a plurality of deck hooks connected to each of the respective opposite ends of the decking structure for connecting the decking structure to the supporting members of the scaffold assembly; and wherein the activation switches are each positioned near a respective one of the opposing ends adjacent at least one of the deck hooks and configured to actuate the pins when the decking structure is connected to or otherwise installed with respect to: (i) the another decking structure in end-to-end fashion and (ii) at least one of the supporting members of the scaffold assembly such that the pins retract into or with respect to the rail upon actuation of the corresponding activation switch so as to permit an individual to move beyond one of the opposing ends of the decking structure and onto the another decking structure, and further wherein the pin is configured to extend out from or with respect to the rail when the decking structure is disconnected and/or otherwise disassembled from (i) such another decking structure and (ii) at least one of the supporting members of the scaffold assembly so as to prevent the individual from moving beyond one of the opposing ends of the decking structure.

2. The assembly of claim 1 further comprising a deck latch assembly located in a central or substantially central region of the decking structure and connected to the first uplift hook mechanism for facilitating connection of the deck structure to a second deck structure.

3. The assembly of claim 2, wherein the deck latch assembly further comprises:

a pair of shackle mechanisms, each shackle mechanism having at least one pin or pin-like mechanism;

a latch mechanism having a recessed cam profile on each of its sides so as to receive or accept the respective at least one pin or pin-like mechanism for connecting the pair of shackle mechanisms to the latch mechanism;

a pull rod mechanism having a pair of pull rods, each pull rod connected to a respective one of the pair of shackle mechanisms for engaging/disengaging the first uplift hook mechanism from the second deck structure; and an axle in operable association with the latch mechanism for operating the deck latch assembly; wherein the engagement/disengagement of the first uplift hook mechanism causes a stop pin mechanism to extend and/or retract from the rail assembly.

4. The assembly of claim 3, wherein the extension and/or retraction of the stop pin mechanism provides a continuous, automatic and hands-free fall arrestor system.

5. The assembly of claim 3, wherein the latch mechanism is rotatable, and when so rotated, each of the at least one pin or pin-like mechanism of the respective pair of shackle mechanisms and the pull rod mechanism is pulled along the respective recessed cam profile in a direction that is at least towards a centralized region of the decking structure.

6. The assembly of claim 1, wherein the rail extends along a longitudinal length of the deck structure and is disposed on the top surface of the decking structure.

7. The assembly of claim 1, further comprising a handle mechanism connected to the first uplift hook mechanism via at least one cable device, and wherein rotation of the handle mechanism creates tension on the at least one device to move the first uplift hook mechanism so as to secure and/or separate the first uplift hook mechanism with respect to a supporting scaffold member.

8. The assembly of claim 1 further comprising a second uplift hook mechanism connected to the deck latch assembly, wherein the first and the second uplift hook mechanisms are positioned at opposite ends of the decking structure to facilitate connection to other decking structures; wherein the first and the second uplift hook mechanisms are spring loaded; and wherein the deck latch assembly is located in a central or substantially central region of the decking structure.

9. The assembly of claim 1, wherein the moveable tie-off apparatus is configured for moving along or on top of the rail mechanism so that a scaffold worker can-be provided with a range of movement on the decking structure when erecting a scaffold assembly.

10. The assembly of claim 1, wherein at least one of the decking structure and the plurality of deck hooks is constructed of aluminum.

11. A method of installing the fall arrest assembly of claim 1, the method comprising:

locating the anchor point on the rail assembly; and attaching one or more lanyard mechanisms to the anchor point on the rail assembly for providing a range of motion on the deck structure when erecting a scaffold assembly.

12. The method of claim 11, further comprises: connecting the first uplift hook mechanism with at least one of the supporting members of the scaffold assembly to releasably secure the decking structure to the at least one supporting member of the scaffold assembly.

13. The method of claim 11, further comprising: connecting the decking structure to the scaffold assembly using one or more of the deck hooks; extending and/or retracting one or more of the stop pins; and providing a continuous, automatic and hands-free fall arrest assembly.

14. The assembly of claim 1, further comprising at least one cable device that is connected to the first uplift hook mechanism, and wherein the device is used to move the first uplift hook mechanism with respect to the at least one supporting member.

* * * * *